US005667080A

United States Patent [19]

Klein

[11] Patent Number: 5,667,080

[45] Date of Patent: Sep. 16, 1997

[54] JEWELERS VACUUM

[76] Inventor: Stanley Klein, 61-20 Grand Central Parkway, Forest Hills, N.Y. 11375

[21] Appl. No.: 503,182

[22] Filed: Jul. 17, 1995

[51] Int. Cl.[6] ..... B07C 7/04

[52] U.S. Cl. ..... 209/614; 209/235; 209/250; 209/261; 209/355; 209/906

[58] Field of Search ..... 209/614, 235, 209/250, 261, 262, 353, 355, 906; 15/347, 344, 350

[56] References Cited

U.S. PATENT DOCUMENTS

| | | | |
|---|---|---|---|
| D. 337,400 | 7/1993 | Bart | D32/18 |
| D. 338,752 | 8/1993 | Bart | D32/18 |
| 4,011,624 | 3/1977 | Proett | 15/344 |
| 4,209,875 | 7/1980 | Pugh et al. | 15/344 |
| 5,189,753 | 3/1993 | Sousa et al. . | |
| 5,224,238 | 7/1993 | Bartlett . | |
| 5,411,150 | 5/1995 | Sigurdsson | 209/235 |

*Primary Examiner*—David H. Bollinger
*Attorney, Agent, or Firm*—Richard A. Joel, Esq.

[57] ABSTRACT

A hand-held jeweler's vacuum comprises an elongated vacuum member with an opening at one end, motor drive means located at the other end and an aperture in the bottom of the elongated member. A detachable box member is mounted beneath the aperture to receive stones and metal pieces. Internally, a mesh filter and a vacuum filter are positioned in the intake path at approximately a 45 degree angle to the air flow and a pre-determined distance apart. In operation, the vacuum picks up metal and stones which are stopped by the mesh filter and the vacuum filter from proceeding through the vacuum filter and the stones and metals fall into the box. The stones and metals can the be removed while other particles are collected in the storage space beyond the filters. The invention permits the salvage of small stones and precious metals which otherwise would be lost during the manufacturing process.

6 Claims, 2 Drawing Sheets

JEWELERS VACUUM

BACKGROUND OF THE INVENTION

In jewelry manufacture glass stones, colored stones, diamonds and all types of metal are generally lost due to the size of the various scraps. This invention proposes a jeweler's vacuum which will pick up these stones and metals and deposit them conveniently in a box. Accordingly a vacuum is provided to pick-up the desired elements and a specific filter arrangement deposits the stones etc. in a detachable box beneath the vacuum. The prior art includes various cordless hand-held portable vacuums such as shown in D 338752 and D 337400. U.S. Pat. No. 5,189,753 discloses and automobile vacuum cleaning system for automobiles which is self contained and portable. The operation of typical vacuums are shown in U.S. Pat. No. 5,224,238. U.S. Pat. No. 5,189,753 discloses an automatic automobile vacuum cleaner which is installed in a convenient portion of the vehicle such as the trunk.

While portable vacuum cleaners are well known, U.S. Pat. Nos. 4,011,624 and 4,209,875 are particularly relevant in this area none of the references disclose a portable hand-held vacuum cleaner which is particularly suited for use by jewelers where precious metals and stones are involved.

SUMMARY OF THE INVENTION

This invention relates to jewelry manufacturing apparatus and particularly to apparatus for salvaging small scraps of precious metal and gems.

In the manufacture of jewelry small scraps of precious metal are created and fall in or about the artisan's work station. The purpose of this invention is to salvage these scraps and stones which over a period of time amount to a considerable loss. The inventor has modified a conventional hand held vacuum to provide a solution to this problem.

A first mesh screen and a second finer mesh screen are mounted at an angle to the upper surface of the vacuum nozzle. The screens are inserted into a slot in the upper surface at an angle to the air flow. A detachable box is mounted on the base of the nozzle to catch salvage from the screens. Thus scraps of precious metal and tiny gems may be readily recovered.

Accordingly it is an object of this invention for a new and improved apparatus for salvaging small scraps of precious metals and gems.

Another object of this invention is to provide a means of easily and efficiently recovering scraps of precious metal and gems during jewelry manufacturing by using a vacuum.

A further object of this invention to provide a new and improved apparatus for salvaging small gems and scraps of precious metal using a vacuum device having a plurality of removable mesh screens.

A more specific object of this invention is to provide a new and improved vacuum apparatus for picking up jewelry scraps of precious metal and gems from a manufacturing location with a portable vacuum means having removable filters which deflect the gems into a detachable storage box.

BRIEF DESCRIPTION OF THE DRAWINGS

The above and other objects and advantages of the invention may be more clearly seen when viewed in conjunction with the accompanying drawings wherein.

DETAILED DESCRIPTION OF THE INVENTION

Figure 1:
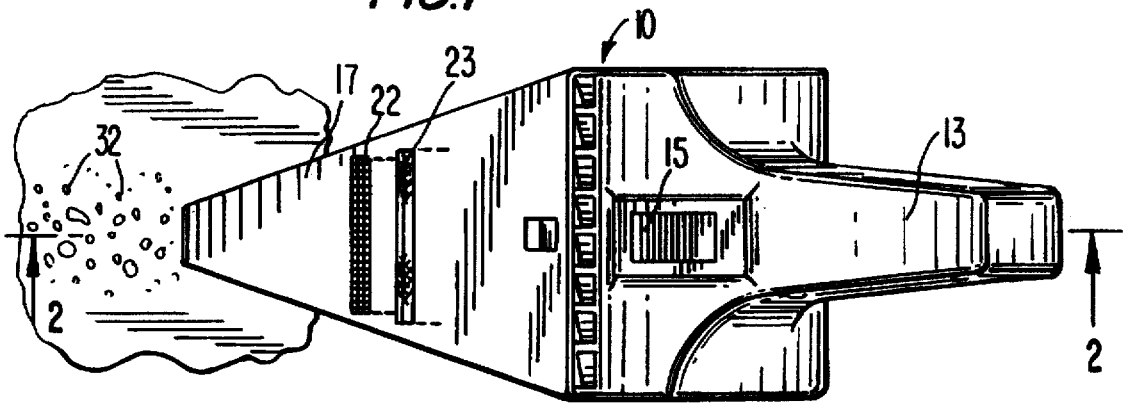
FIG. 1 is a top view of the invention in use.
Figure 3:
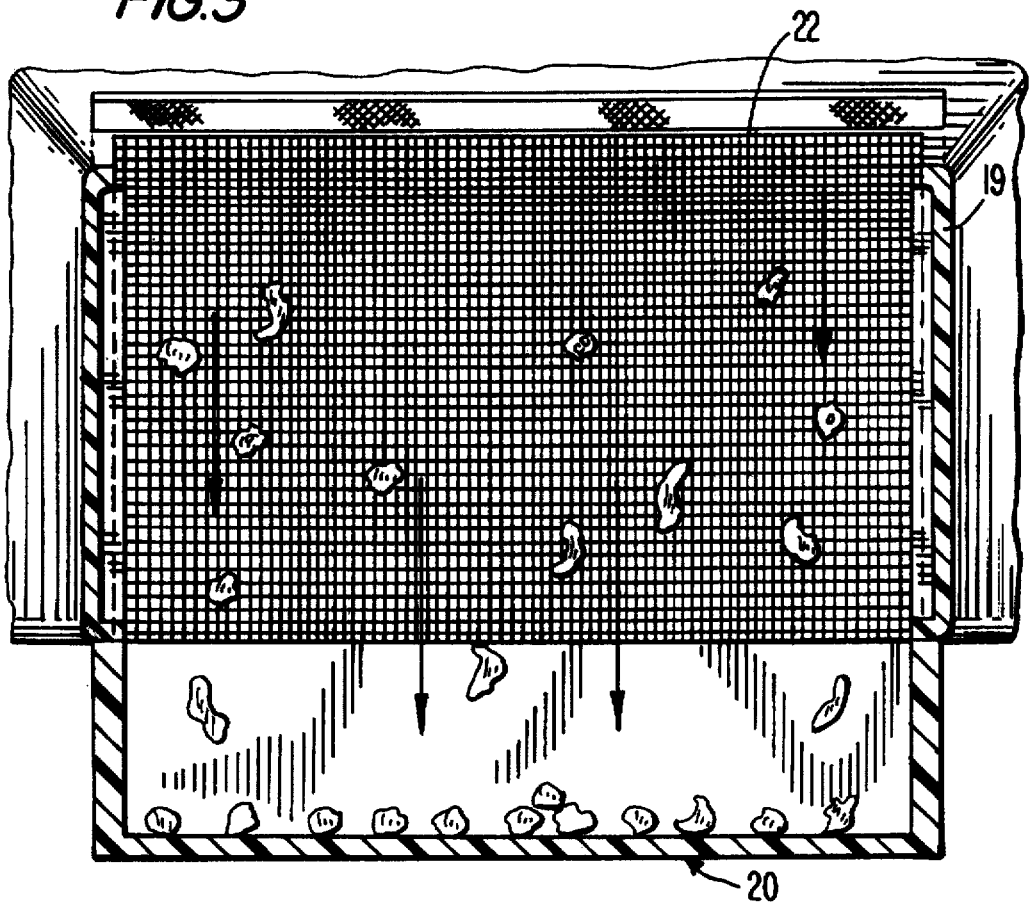
Figure 2:
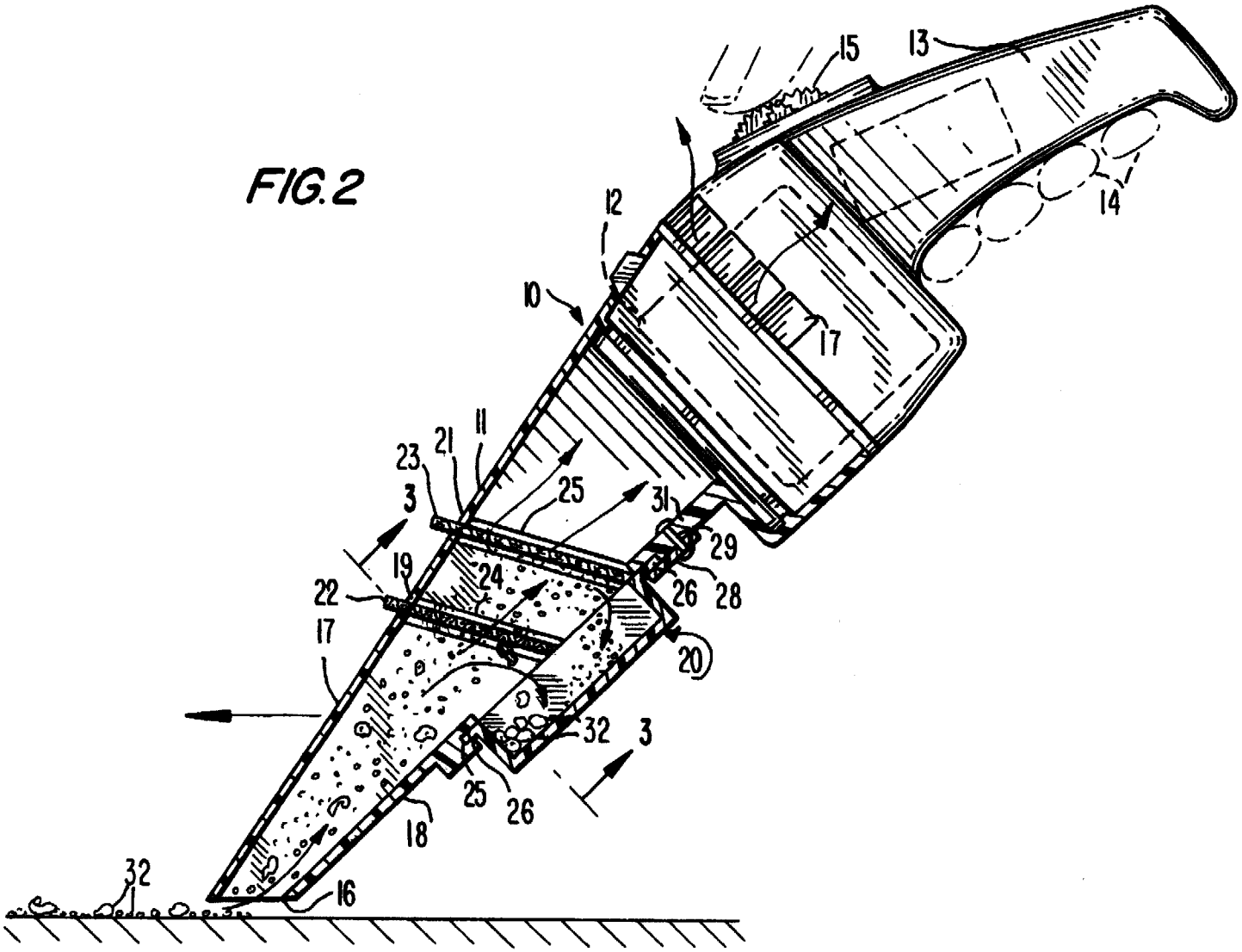
FIG. 2 is a cross sectional view of the invention taken along the line of 2–2 of FIG. 1; and, FIG. 3 is a view of the invention taken along the line 3–3 of FIG. 2.

Referring now to the drawings, the invention comprises a vacuum apparatus 10 with a nozzle 11, motor means 12 and a handle 13. The handle 13 is grasped by ones fingers 14 and a switch 15 is actuated to drive the motor 12 causing a vacuum, as the air is driven from the intake aperture 16 through the outlets 17 in the direction of the arrows.

The nozzle 11 includes an intake aperture 16 and an upper surface 17 and a lower surface 18 which is sloped at an angle to the upper surface 17. The upper surface 17 includes slots 19 and 21 into which are slid mesh screens 22 and 23 the slots 19 and 21 include supports for the supports 24 and 25 for the mesh screens which are mounted at an angle to the upper surface 17 and the direction of air flow. The lower surface 18 includes a detachable box 20 which includes a projecting upper lip 26 which fits into the slots 27 at its forward end and is retained in position against the apparatus 10 by fastening means 29 and member 28.

In use, the apparatus 10 is moved along a surface 31 having scraps of metal and gems 32 thereon. The salvage materials are vacuumed into the nozzle 11 where they are deflected by screens 22 and 23 into the detachable box 20 the angular position of the screens 22 and 23 is essential to the deflection of the salvage material and it also assists the moving of the salvage into the box by the deflection of the air currents. The mesh on the second screen 23 may be somewhat finer in order to deflect even smaller particles. The air flow continues through the vacuum and a separate catchment arrangement can be mounted in the rear of the nozzle 11 in order to catch dirt and other debris which flow though the filter.

While the invention has been explained by a detailed description of certain specific embodiments, it is understood that various modifications and substitutions can be made in any of them within the scope of the appended claims which are intended also to include equivalents of such embodiments.

What is claimed, is:

1. A jewelers vacuum for salvaging small stones and precious metal scraps comprises:

a hand held vacuum having a nozzle including an upper surface and a lower surface having an aperture at one end and a pair of inclined mounting slots at predetermined intervals on the upper surface of the nozzle and a handle and means for creating a vacuum at the aperture;

a first mesh screen mounted in one of the mounting slots and a second mesh screen mounted in the other mounting slot; and, a detachable box mounted to the lower surface of the nozzle beneath the mesh screens to retrieve the precious metal scraps and stones which fail to pass through the filters.

2. A jewelers vacuum for salvaging small stones and precious metal scraps in accordance with claim 1 wherein:

the first mesh screen is of a larger size that the second mesh screen.

3. A jewelers vacuum for salvaging small stones and precious metal scraps in accordance with claim 2 wherein:

the detachable box comprises a base having upwardly projecting walls and an outwardly projecting flange at the upper end of said walls; and, means mounting the flange to the lower surface of the nozzle over the aperture therein.

4. A jewelers vacuum for salvaging small stones and precious metal scraps in accordance with claim 3 wherein:

the lower surface is at an angle to the upper surface of the nozzle and side walls join the both surfaces.

5. A jewelers vacuum for salvaging small stones and precious metal scraps in accordance with claim 2 wherein:

the mounting slots each include a frame to support said mesh screens.

6. A jewelers vacuum for salvaging small stones and precious metal scraps in accordance with claim 2 further including:

a waste area within the vacuum for collecting dust and other debris fine enough to pass through the screens.

* * * * *